US008628216B2

(12) United States Patent
Ivey et al.

(10) Patent No.: US 8,628,216 B2
(45) Date of Patent: Jan. 14, 2014

(54) LIGHTING INCLUDING INTEGRAL COMMUNICATION APPARATUS

(75) Inventors: John Ivey, Farmington Hills, MI (US); David L. Simon, Gross Pointe Woods, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

(21) Appl. No.: 13/569,647

(22) Filed: Aug. 8, 2012

(65) Prior Publication Data

US 2012/0307485 A1 Dec. 6, 2012

Related U.S. Application Data

(63) Continuation of application No. 12/985,049, filed on Jan. 5, 2011, now Pat. No. 8,251,544, which is a continuation of application No. 12/257,691, filed on Oct. 24, 2008, now Pat. No. 7,938,562.

(51) Int. Cl.
*F21V 33/00* (2006.01)

(52) U.S. Cl.
USPC ..... 362/276; 362/234; 362/253

(58) Field of Classification Search
USPC ..... 362/276, 234, 253, 295, 394, 411, 800, 362/802, 217.01–217.09, 217.1–217.17, 362/218–225
See application file for complete search history.

(56) References Cited

U.S. PATENT DOCUMENTS

| | | | | |
|---|---|---|---|---|
| 5,688,042 | A * | 11/1997 | Madadi et al. | 362/240 |
| 6,072,280 | A * | 6/2000 | Allen | 315/185 S |
| 7,938,562 | B2 * | 5/2011 | Ivey et al. | 362/276 |
| 8,251,544 | B2 * | 8/2012 | Ivey et al. | 362/276 |
| 2007/0109763 | A1 * | 5/2007 | Wolf et al. | 362/86 |

* cited by examiner

*Primary Examiner* — Bao Q Truong
(74) *Attorney, Agent, or Firm* — Young Basile

(57) ABSTRACT

A lighting and communication system for use in a standardized light fixture is provided. The lighting and communication system includes a light source and a communication apparatus. At least one electrical connector configured for physical and electrical connection to the standardized light fixture is included, and the at least one electrical connector is electrically connected to the light source and the communication apparatus.

13 Claims, 4 Drawing Sheets

LIGHTING INCLUDING INTEGRAL COMMUNICATION APPARATUS

CROSS-REFERENCE TO RELATED APPLICATIONS

This application is a continuation of U.S. patent application Ser. No. 12/985,049, filed Jan. 5, 2011, which is a continuation of U.S. patent application Ser. No. 12/257,691, filed Oct. 24, 2008, both of which are incorporated herein by reference in their entireties.

TECHNICAL FIELD

The present invention relates to building communication systems, and more particularly to integrating building communication system components with building lighting.

BACKGROUND

Many buildings have lighting systems. For example, many commercial buildings include fluorescent lighting fixtures for use with fluorescent tubes, though other types of lighting systems using other types of lights (e.g., incandescent lights) may also be used. Fixtures are typically hard-wired to a power source, such as an electric utility line. The lighting system may produce a generally constant flux of light so long as a switch controlling the lighting system is in an "on" position. Typically, the sole function of lighting systems is providing light.

Many buildings also have one or more sound systems. For example, an alarm sound system may be part of an alarm system for notifying building occupants of an emergency. While alarm sound systems may include emergency lighting, the emergency lighting is typically active only during the emergency to supplement the notice of the emergency provided by the alarm sound. The emergency lighting included with some sound systems, such as a strobe light, is typically not designed to provide normal lighting for a building. Another type of sound system includes speakers for making announcements. Such speakers typically do not include lighting. Sound systems, including both the alarm sound system and announcement speakers, typically are separate from and operate independently of lighting systems.

Many buildings also have one or more cameras for security purposes. Most cameras are separate from and operate independently of both lighting systems and sound systems.

BRIEF SUMMARY

Embodiments of the present invention provide a lighting and communication system for use in a standardized light fixture. In one example, Embodiments of a lighting and communication system for use in a standardized fluorescent fixture are disclosed herein. In one such embodiment, the lighting and communication system includes a light source, a communication apparatus and a housing at least partially enclosing the light source and the communication apparatus. The system also includes at least one end cap configured for physical and electrical connection to the standardized light fixture. The at least one end cap is electrically connected to the light source and the communication apparatus and includes a pair of pin-carrying connectors. The housing and the pair of pin-carrying connectors at least partially define a single package sized for use in the standardized fluorescent fixture.

In another embodiment, the light the lighting and communication system includes at least one LED, a communication apparatus configured to generate a signal useable by a controller to control a brightness of the at least one LED and a pair of pin-carrying connectors for physical and electrical connection to the fluorescent fixture. The connectors are electrically connected to the at least one LED and the communication apparatus.

Embodiments of a lighting and communication system for use in a standardized light fixture are disclosed herein. The lighting and communication system includes a light source, a communication apparatus, a controller operative to control a brightness of the light source in response to an input signal received from the communication apparatus and a housing at least partially enclosing the light source and the communication apparatus. The system also includes at least one connector configured for physical connection to the standardized light fixture. The housing and the connector at least partially define a single package sized for use in the standardized light fixture.

These and other embodiments will be described in additional detail hereafter.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
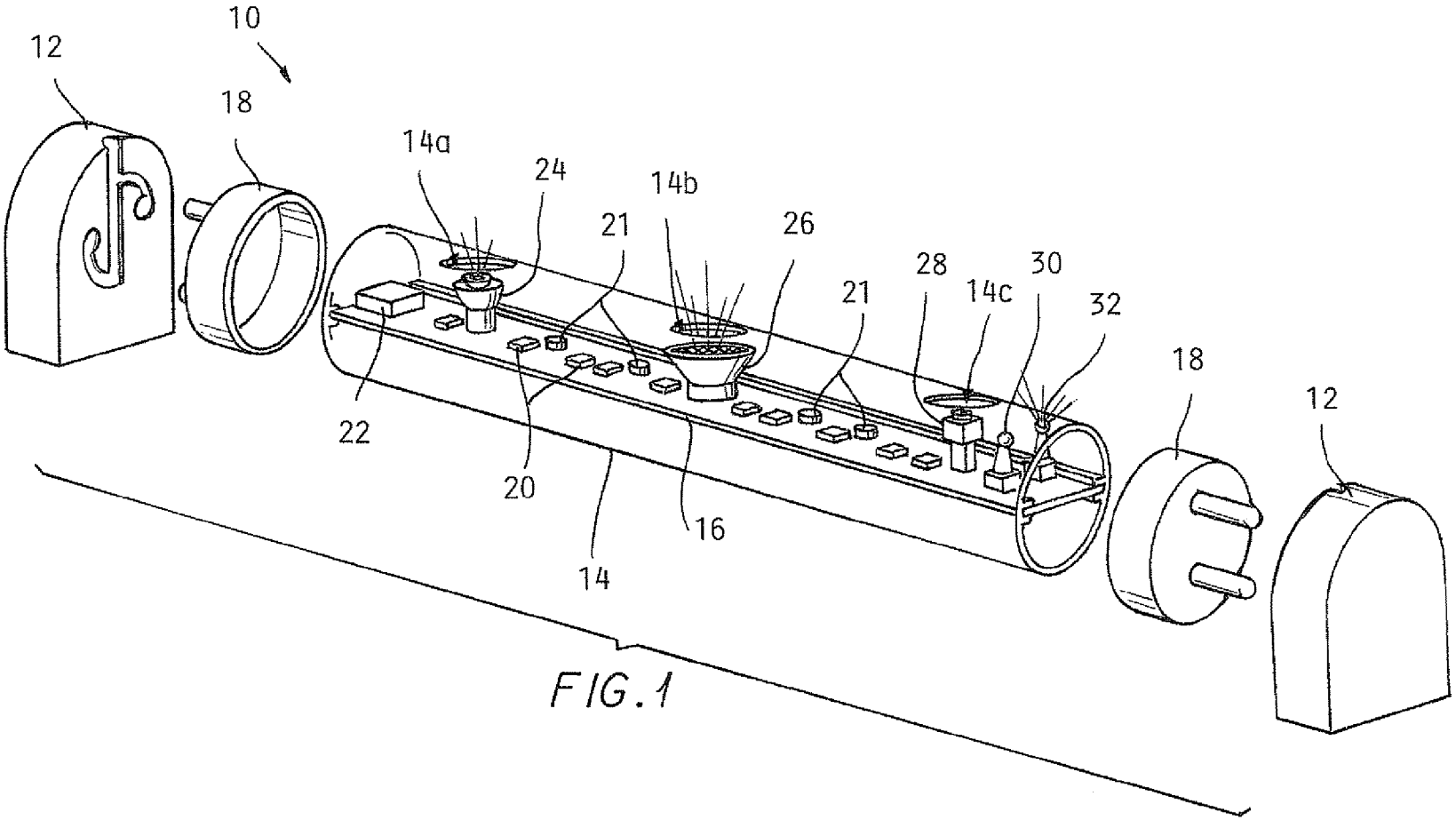
FIG. 1 is a perspective view of an example of a light and communication system.

Examples of light and communication systems according to the invention are discussed with reference to FIGS. 1-4. FIG. 1 illustrates a light and communication system 10 for use in a standard fixture 12, such as a fixture designed to accept T5, T8, T10, or T12 tubes. As such, the system 10 can have the shape of a standard tube, i.e., the shape of a T5, T8, T10, or T12 tube, or otherwise be shaped for compatibility with the standard fixture 12. Alternatively, another example of a light and communication system can have an alternative shape from the illustrated system 10 for use in fixtures that accept other types of standard sized lights, such as the shape of an incandescent bulb as shown in FIG. 4 or standard sized halogen lamps. However, all examples of light and communication systems need not be compatible with the fixture 12 or another type of standard fixture. That is, yet another example of a light and communication system can be powered by a battery or connected to a power source by means such as hard-wiring the system to a power source.

As shown in FIG. 1, the light and communication system 10 includes a housing 14, a circuit board 16, a pair of end caps 18, LEDs 20, a controller 22, an audio device including a microphone 24 and a speaker 26, a camera 28, a receiver 30, and a transmitter 32. The housing 14 as shown in FIG. 1 is a light transmitting cylindrical tube. The housing 14 can be made from polycarbonate, acrylic, glass or another light transmitting material (i.e., the housing 14 can be transparent or translucent). For example, a translucent housing 14 can be made from a composite, such as polycarbonate with particles of a light refracting material interspersed in the polycarbonate. While the illustrated housing 14 is cylindrical, a housing having a square, triangular, polygonal, or other cross sectional shape can alternatively be used. Similarly, while the illustrated housing 14 is linear, a housing having an alternative shape, e.g., a U-shape or a circular shape can alternatively be used. Additionally, the housing 14 need not be a single piece as shown in FIG. 1. Instead, another example of a housing can be formed by attaching multiple individual parts, not all of which need be light transmitting. For example, such a housing can include an opaque lower portion and a lens or other transparent cover attached to the lower portion to cover the LEDs 20. The housing 14 can be manufactured to include light diffusing or refracting properties, such as by surface roughening or applying a diffusing film to the housing 14. For compatibility with the fixture 12 as discussed above, the housing 14 can have a length such that the light 10 is approximately 48" long, and the housing 14 can have a 0.625", 1.0", or 1.5" diameter. The housing 14 can define first, second, and third apertures 14*a*, 14*b*, and 14*c* as discussed below.

The circuit board 16 as illustrated in FIG. 1 is an elongate printed circuit board. Multiple circuit board sections can be joined by bridge connectors to create the circuit board 16. The circuit board 16 as shown in FIG. 1 is slidably engaged with the housing 14, though the circuit board 16 can alternatively be clipped, adhered, snap- or friction-fit, screwed or otherwise connected to the housing 14. For example, the circuit board 16 can be mounted on a heat sink that is attached to the housing 14. Also, other types of circuit boards may be used, such as a metal core circuit board. Or, instead of a circuit board 16, other types of electrical connections (e.g., wires) can be used to electrically connect the LEDs 20 to a power source.

The light and communication system 10 can include two bi-pin end caps 18 (i.e., each end cap 18 can carry two pins), one at each longitudinal end of the housing 14, for physically and electrically connecting the system 10 to the fixture 12. The end caps 18 can be the sole physical connection between the light and communication system 10 and the fixture 12. The end caps 18 can be electrically connected to the circuit board 16 to provide power to the LEDs 20 and other components (e.g., the microphone 24, speaker 26, and camera 28). Each end cap 18 can include two pins, though two of the total four pins can be "dummy pins" that do not provide an electrical connection. Alternatively, other types of electrical connectors can be used, such as an end cap carrying a single pin. Also, while the end caps 18 are shown as including cup-shaped bodies, apparatuses having a different configuration can alternatively be used (e.g., plugs lodged in ends of the housing 14 can carry pins or other electrical connectors). One or both of the end caps 18 can additionally include electric components, such as a rectifier and filter.

The LEDs 20 can be surface-mount devices of a type available from Nichia, though other types of LEDs can alternatively be used. For example, although surface-mounted LEDs 20 are shown, one or more organic LEDs can be used in place of or in addition thereto. The LEDs 20 can be mounted to the circuit board 16 by solder, a snap-fit connection, or other means. The LEDs 20 can produce white light. However, LEDs that produce blue light, ultra-violet light or other wavelengths of light can be used in place of white light emitting LEDs 20. Additionally, notification LEDs 21 can be included. Notification LEDs 21 can be identical to LEDs 20, except notification LEDs 21 can produce a different color of light than LEDs 20 (e.g., if the LEDs 20 produce white light as described above, notification LEDs 21 can produce red light).

The number of LEDs 20 can be a function of the desired amount of light produced by the light and communication system 10 and the power of the LEDs 20. For a 48" light, such as the illustrated light and communication system 10, the number of LEDs 20 can vary from about five to four hundred such that the system 10 outputs approximately 500 to 3,000 lumens. However, a different number of LEDs 20 can alternatively be used, and the system 10 can output a different amount of lumens. The LEDs 20 can be evenly spaced along the circuit board 16, and the spacing of the LEDs 20 can be determined based on, for example, the light distribution of each LED 20 and the number of LEDs 20.

The controller 22 can be digital and include a CPU and a memory, such as RAM or another type of memory, though a controller including analog circuits can be used. The controller 22 can be mounted on the circuit board 16 to receive power from one or both of the end caps 18, though the controller 22 can be coupled to a different power source such as a battery. The controller 22 can also be in communication with the LEDs 20 and 21, the microphone 24, the speaker 26, the camera 28, the receiver 30, and the transmitter 32. The memory can store a program for determining an operating mode of at least some components of the system 10, such as the LEDs 20, the microphone 24, the speaker 26, and the camera 28. Additionally, the memory can store sound files for transmission to the speaker 26, and the memory can include empty space for storing sound files corresponding to sounds captured by the microphone 24. The functionality of the controller 22 is discussed below in greater detail in reference to FIGS. 2 and 3.

The audio device can include the microphone 24 and the speaker 26 as mentioned above. The microphone 24 can be positioned to capture sound waves produced outside the housing 14. For example, the housing 14 can define the first aperture 14*a*, and the microphone 24 can be positioned adjacent the first aperture 14*a* such that sound waves produced outside the housing 14 can reach the microphone 24 to avoid sound waves having to pass through the housing 14 to reach the microphone 24. While not illustrated, the microphone 24 can substantially fill the aperture 14*a*, and a seal can be included between the microphone 24 and aperture 14*a* to protect the circuit board 16 and other components inside the housing 14. As another example, the microphone 24 can be mounted to an exterior of the housing 14. The microphone 24 can be in communication with the controller 22 and/or the transmitter 32. The microphone 24 can be mounted on the circuit board 16 for receiving power passing from the fixture 12 to the circuit board 16 via at least one of the end caps 18 and for communicating the audio input signal to the controller 22 and/or the transmitter 32. Alternatively, the microphone 24 can be powered by another power source (e.g., a battery). The microphone 24 can produce an audio input signal $\alpha$ corresponding to captured sound waves, and the microphone 24 can communicate the audio input signal $\alpha$ to the controller 22 and the transmitter 32.

The speaker 26 can be positioned to produce sound waves that travel outside the housing 14. For example, the housing 14 can define the second aperture 14*b*, and the speaker 26 can be positioned adjacent to the second aperture 14*b* such that sound waves produced by the speaker 26 can pass unobstructed (e.g., without having to pass through the housing 14) to an area outside the housing 14. While not illustrated, the speaker 26 can substantially fill the aperture 14*b*, and a seal can be included between the speaker 26 and aperture 14*b* to protect the circuit board 16 and other components inside the housing 14. Alternatively, the speaker 26 can be mounted at an alternative location, such as on an exterior of the housing 14. The speaker 26 can be mounted on the circuit board 16 for receiving power passing from the fixture 12 to the circuit board 16 via at least one of the end caps 18, though the speaker 26 can alternatively be powered by another power source (e.g., a battery), and for communication with the controller 22 and/or the receiver 30. The speaker 26 can transform an audio output signal β communicated from the controller 22 or receiver 30 into audible sound waves. Additionally, more than one speaker 26 can be included.

The camera 28 can be positioned to capture video or still images of an area outside the housing 14. For example, the housing 14 can define the third aperture 14*c*, and a lens of the camera 28 can be positioned adjacent the third aperture 14*c* such that light waves can pass unobstructed from outside the housing 14 to the lens of the camera 28. While not illustrated, the camera 28 can substantially fill the aperture 14*c*, and a seal can be included between the camera 28 and aperture 14*c* to protect the circuit board 16 and other components inside the housing 14. As another example, the camera 28 can be mounted on an exterior of the housing 14, or the camera 28 can be mounted to face a transparent portion of the housing 14 through which the camera 28 can capture images. The camera 28 can be electrically coupled to the circuit board 16 to receive power from the end caps 18 and for communication with the controller 22 and/or the transmitter 30. Alternatively, the camera 28 can be powered by another source (e.g., a battery), and the camera 28 can communicate with the controller 22 and/or transmitter 30 wirelessly or via a hard-wire not integral with the circuit board 16. The camera 28 can also include additional equipment. For example, the camera 28 can be mounted on a motorized pivot for movement tracking of an object moving relative to the system 10, or the camera 28 can be mounted on an adjustable pivot such that the camera 28 can be oriented to capture images of a certain area of a room when installed in the fixture 12. The camera 28 can output an image signal γ corresponding to either still images or video to the controller 22 and/or transmitter 32.

The receiver 30 can be in communication with a remote source, such as a security center, for receiving the audio output signal β. The receiver 30 can be in wireless communication with the remote source using a standard wireless protocol such as IEEE 802.11, a protocol for radio communication, Bluetooth, a cellular standard (e.g., 3G), or another wireless protocol. Alternatively, the receiver 30 can be hard-wired in communication with the remote source using a telephone line, an Ethernet line, an electrical line, or another physical coupling. The receiver 30 can be mounted on the circuit board 16 for receiving power from the end caps 18 and for communication with the controller 22 and/or the speaker 26. Alternatively, the receiver 30 can be powered by a different source (e.g., a battery) and be coupled to the controller 22 and/or speaker 26 wirelessly or through a hard wire not integral with the circuit board 16. The receiver 30 can receive also receive a control signal δ including instructions for controlling the LEDs 20, the notification LEDs 21, the speaker 26, and/or the camera 28.

The transmitter 32 can also be in communication with the remote source for transmitting at least one of the audio input signal α and the image signal γ to the remote source. The transmitter 32 can be in wireless communication with the remote source using one of the wireless protocols mentioned above, or the transmitter 32 can be hard-wired to the remote source. The transmitter 32 can be mounted on the circuit board 16 for receiving power from the end caps 32 and for communication with the controller 22, the microphone 24, and/or the camera 28. Alternatively, the transmitter 30 can be powered by a different source (e.g., a battery) and can be coupled to the controller 22, audio device, and/or camera 28 wirelessly or through a hard wire not integral with the circuit board 16.

Figure 2:
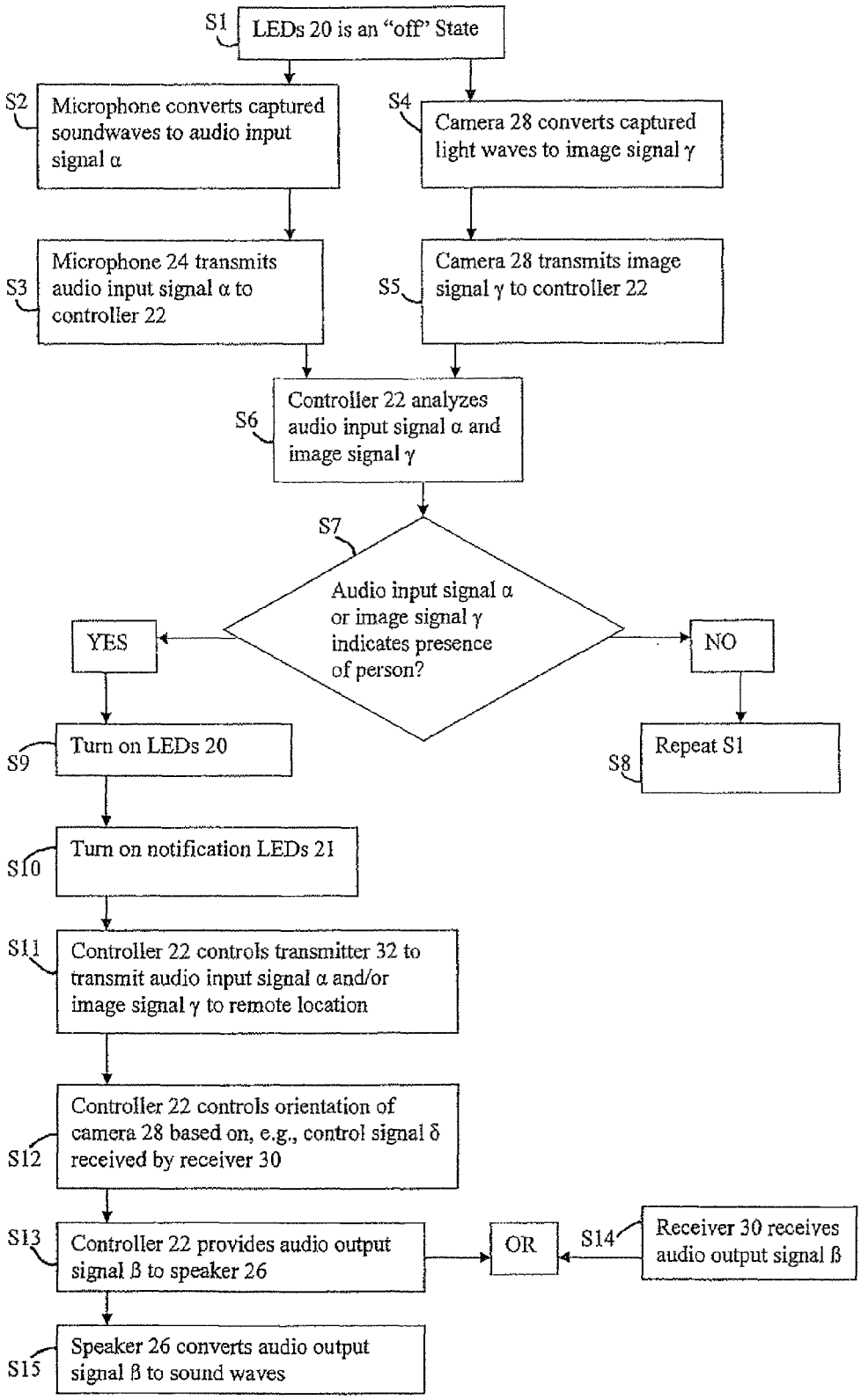
FIG. 2 is a flowchart showing an example of the light and communication system of FIG. 1 in operation.

The system 10 can perform several functions when installed in the fixture 12. For example, as shown in FIG. 2, in step S1 the LEDs 20 are in an "off" state. That is, the controller 22 is not providing power to the LEDs 20. In step S2, the microphone 24 can capture sound waves and convert the sound waves to generate the audio input signal α. In step S3, the microphone 24 can transmit the audio input signal α to the controller 22. Similarly, in steps S4 and S5, respectively, the camera 28 can capture light waves and convert the light waves to generate the image signal γ and transmit the image signal γ to the controller 22. Alternatively, only one set of steps S2 and S3 or steps S4 and S5 can be performed. Additionally or alternatively, the microphone 24 and camera 28 can transmit the audio input signal α and the image signal γ, respectively, to the transmitter 32. Also, while the process of FIG. 2 is described as occurring while the LEDs 20 are in an "off" state, a similar process can be performed when the LEDs 20 are in an "on" state as is described below with reference to FIG. 3.

In step S6, the controller 22 analyzes the audio input signal α and the image signal γ. For example, the controller 22 can analyze the audio input signal α to determine whether a sound over a predetermined volume is produced, whether a spike in sound to a predetermined level greater than a level of normal background noise is produced, whether a series of sounds at similar frequency to footsteps are produced, whether a sound corresponding to human speech is produced, or whether some other sound indicative of the presence of a person is produced. Similarly, the controller 22 can analyze the image signal γ by performing a facial recognition analysis, comparing successive images of video to detect a moving object, or performing another analysis. In step S7, the controller 22 determines whether a person is present based on the analysis of step S6. Alternatively, the controller 22 can analyze the audio input signal α and the image signal γ for the presence of something other than a person, such as a fire if the camera 28 is an infrared camera. Also, instead of or in addition to steps S6 and S7, the transmitter 32 can transmit the audio input signal α and the image signal γ to the remote location, and personnel at the remote location can select an appropriate course of action and transmit the control signal δ to the receiver 30.

In step S8, the controller 22 determines that no person is present, in which case the LEDs 20 remain in the "off" state and the process can be repeated continuously or after a predetermined time. Step S9, however, can be performed if the controller 22 determines that a person is present. In this case, any of steps S9 through S15 can be performed, though in another example fewer than all of steps S9 and S15 can be performed.

In step S9, the controller 22 turns on the LEDs 20. The controller 22 can turn the LEDs 20 on to operate in a normal mode in which the LEDs 20 produce a generally constant flux of light, or the controller 22 can operate the LEDs 20 in an alarm mode in which the LEDs 20 flash or produce some other pattern of light. Similarly, in step S10, the controller 20 can turn on the notification LEDs 21, thereby producing a red light that can provide a warning or other message to a viewer.

Additionally, in step S11, the controller 22 can instruct the transmitter 32 to transmit the audio input signal α and the image signal γ to the remote location. Thus, personnel at the remote location can take appropriate action, such as transmitting the control signal δ to the receiver 30, or the audio input signal α and the image signal γ can be recorded for later viewing. Step S12 shows an example of personnel at the remote location transmitting the control signal δ to the controller 22 via the receiver 30. As shown, the control signal δ can include an instruction for the controller 22 to change the orientation of the camera 28 (e.g., by controlling a motor coupled to a pivot on which the camera 28 is mounted).

In step S13, the controller 22 can provide the audio output signal β from its memory to the speaker 26. The audio output signal β can correspond to an alarm sound, a pre-recorded warning (e.g., "Exit the building."), or some other sound. In step S15, the speaker 26 can convert the audio output signal β into sound waves. Instead of having the speaker 26 produce the audio output signal β as stored on the memory portion of the controller 22, step S14 shows an additional example of a response of personnel at the remote location in which the personnel transmit the audio output signal β to the receiver 30. In this case, the audio output signal β can be, for example, a message spoken by personnel at the remote location. This audio output signal β can also be converted to sound waves by the speaker 26 in step S15.

Figure 3:
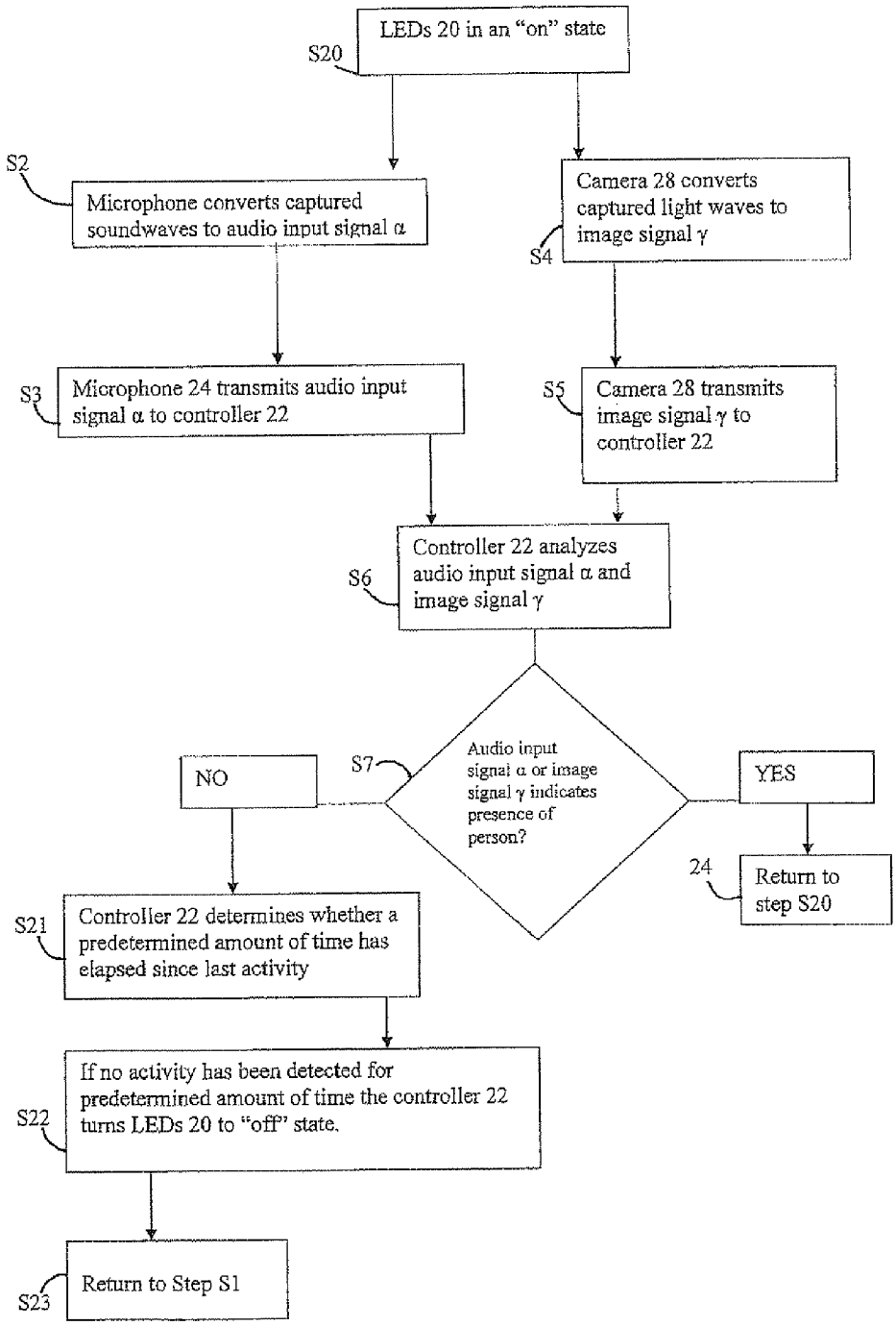
FIG. 3 is a flowchart showing another example of the light and communication system of FIG. 1 in operation.
Figure 4:
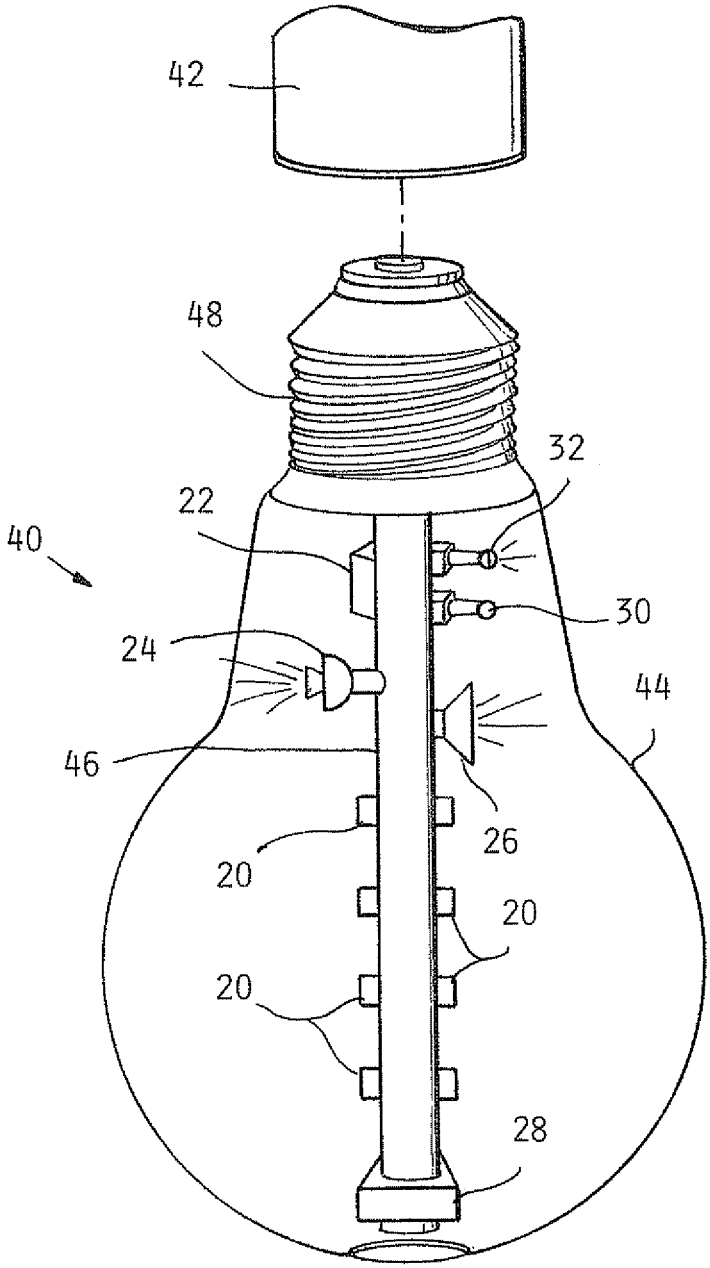
FIG. 4 is a perspective view of another example of a light and communication system.

Another function of the light and communication system 10 is shown in FIG. 3. In step S20, the LEDs 20 are in an "on" state. Steps S2 through S6 can be then be performed as described with reference to FIG. 2. However, while steps S2 through S7 are continuing to be performed continuously or at intervals, the controller 22 in step S21 determines whether a predetermined amount of time (e.g., five minutes) have passed since activity indicating the presence of a person was last detected in step S7. As shown in step S22, if no person has been detected for the predetermined amount of time, the controller 22 can turn off the LEDs 20. After turning the LEDs 20 off, the controller 22 can return to step S1 as shown in FIG. 2.

Additionally, the light and communication system 10 can perform other functions. For example, when a building is in an unoccupied state (e.g., at night or over a vacation period), the controller 22 can provide power to the LEDs 20 at times to give the appearance of activity in the building. Providing power to the LEDs 20 when the building in an unoccupied state can give the appearance of activity in the building to deter trespassers from entering the building. As another example, while the example discussed above in reference to FIG. 2 describes the camera 28 as providing the image signal γ to the remote location upon the detection of the presence of a person, the camera 28 can alternatively provide the image signal γ at a certain time interval (e.g., every fifteen seconds) for analysis by security personnel or to be stored for review in the event a break-in or other incident occurs. As yet another example, the controller 22 can turn on the camera 28, record images captured by the camera, or cause the images captures by the camera 28 to be sent to the remote location based on the audio input signal α (e.g., when the audio input signal α indicates the presence of a person).

The light and communication system 10 offers many advantages. The system 10 can be installed in the standard fixture 12 with no additional wiring, as the entire system 10 can be contained in a single package defined by the housing 14 and end caps 18, allowing for easy and inexpensive implementation of a communication system in a building. The system 10 can be installed in a "smart" building for communication with other components. For example, the receiver 30 can receive the control signal δ from a door ajar sensor separate from the system 10 with instructions to turn on the LEDs 20. Alternatively, the system 10 can be installed in a conventional building to transform the building into a "smart" building.

While the system 10 is shown and described as including the microphone 24, the speaker 26, the camera 28, the receiver 30, and the transmitter 32, another example of the light and communication system can include fewer components (e.g., another example of the system may not include the receiver 30). Also, while the controller 22, audio device, camera 28, receiver 30, and transmitter 32 are described as separate components, one or more of the components can be integral (e.g., single component can function as both the receiver 30 and transmitter 32).

FIG. 4 shows another example of a light and communication system 40 for installation in a standard incandescent socket 42 as mentioned above. A bulb shaped housing 44 can enclose a circuit board 46 in electrical communication with a standard screw base 48, such as an E26 Edison threaded screw base. LEDs 20, the controller 22, the microphone 24, the speaker 26, the camera 28, the receiver 30, and the transmitter 32 can be mounted on the circuit board 46. The camera 28 can be mounted near a tip of the bulb for a wide viewing angle, or multiple cameras 28 can be used.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structures as is permitted under the law.

What is claimed is:

1. A lighting and communication system for use in a standardized fluorescent fixture, the lighting and communication system comprising:

a light source adapter to produce a generally constant flux of light to at least partially satisfy a general lighting requirement in an area surrounding the system:

a communication apparatus configured to generate one or more signals indicative of a presence of a person in the area;

a housing at least partially enclosing the light source and the communication apparatus;

at least one end cap including a pair of pin-carrying connectors configured at least for physical connection to the fixture, wherein the housing and the pair of pin-carrying connectors at least partially define a single package sized for use in the fixture; and a controller operative to control the light source in response to the one or more signals to produce a generally constant flux of light.

2. The lighting and communication system of claim 1, wherein the light source includes at least one LED.

3. The lighting and communication system of claim 1, wherein the communication apparatus is at least one of an audio device or a camera.

4. The lighting and communication system of claim 3, wherein the audio device includes a speaker, and further comprising:

a receiver configured to receive an audio signal; and wherein the speaker is operable to output sound in response to the audio signal.

5. The lighting and communication system of claim 3, wherein the communication apparatus includes a memory operative to store a recording; and wherein the audio device is operative to produce a sound corresponding to the recording.

6. The lighting and communication system of claim 1, wherein the light source includes multiple LEDs arranged along a length of the housing.

7. An LED-based light including a lighting and communication system for use in a fluorescent fixture, the LED-based light comprising:

a light source including at least one LED and adapted to produce a generally constant flux of light to at least partially satisfy a general lighting requirement in an area surrounding the LED-based light;

a communication apparatus configured to generate a signal useable by a controller to control a brightness of the at least one LED, wherein the communication apparatus is at least one of an audio device or a camera configured to generate one or more signals indicative of a presence of a person in the area;

a pair of pin-carrying connectors for physical and electrical connection to the fluorescent fixture, the connectors electrically connected to the at least one LED and the communication apparatus; and a controller operative to control the light source in response to the one or more signals to produce a generally constant flux of light.

8. The LED-based light of claim 7, further comprising:

a receiver configured to receive an audio signal;

wherein the audio device includes a speaker operable to output sound in response to the audio signal.

9. The LED-based light of claim 7, further comprising:

a housing including a light transmitting portion;

wherein the at least one LED is oriented to produce light through the light transmitting portion; and wherein the housing and the pair of pin-carrying connectors define a single package at least partially enclosing the at least one LED and the communication apparatus.

10. The lighting and communication system of claim 1, wherein at least one of the pair of pin-carrying connectors is further configured for electrical connection to the fixture; and wherein the at least one of the pair of pin-carrying connectors is electrically connected to the light source and the communication apparatus.

11. The lighting and communication system of claim 1, wherein the housing includes a light transmitting portion; and wherein the plurality of LEDs is oriented to produce light through the light transmitting portion.

12. The lighting and communication system of claim 1, further comprising:

a battery electrically connected to at least one of the light source and the communication apparatus.

13. The lighting and communication system of claim 1, wherein the communications apparatus comprises:

a camera and an audio device including a microphone; and a transmitter to transmit at least one of audio captured by the microphone and an image captured by the camera.

* * * * *